United States Patent [19]

Taylor

[11] Patent Number: 4,594,828

[45] Date of Patent: Jun. 17, 1986

[54] BUILDING CONSTRUCTION SYSTEM INCLUDING A PROFILE EXTRUSION USED AS A UNIVERSAL STRUCTURAL MEMBER AND ASSEMBLY CLIPS THEREFOR

[75] Inventor: Curtis P. Taylor, Bexly, Ohio

[73] Assignee: Plaskolite, Inc., Columbus, Ohio

[21] Appl. No.: 709,538

[22] Filed: Mar. 8, 1985

[51] Int. Cl.[4] ..... E04B 1/00

[52] U.S. Cl. ..... 52/282; 52/731; 52/713

[58] Field of Search ..... 52/731, 732, 730, 781, 52/713

[56] References Cited

U.S. PATENT DOCUMENTS

| | | | |
|---|---|---|---|
| 1,609,541 | 12/1926 | Gooding | 52/732 X |
| 3,603,054 | 9/1971 | Didry | 52/282 |
| 3,782,048 | 1/1974 | Corman | 52/282 X |
| 4,035,979 | 7/1977 | Koreska | 52/732 X |
| 4,395,862 | 8/1983 | Jäger et al. | 52/731 |

FOREIGN PATENT DOCUMENTS

| | | | |
|---|---|---|---|
| 2656335 | 12/1976 | Fed. Rep. of Germany | 52/730 |
| 2290597 | 11/1974 | France | 52/781 |

*Primary Examiner*—Carl D. Friedman

*Attorney, Agent, or Firm*—Porter, Wright, Morris & Arthur

[57] ABSTRACT

A building construction system using a universal structural extrusion and specially adapted fastener clips, particularly adaptable to a building system exclusively using material formed from plastic, polymeric substances.

3 Claims, 13 Drawing Figures

BUILDING CONSTRUCTION SYSTEM INCLUDING A PROFILE EXTRUSION USED AS A UNIVERSAL STRUCTURAL MEMBER AND ASSEMBLY CLIPS THEREFOR

FIELD OF THE INVENTION

This invention relates to a building construction system and particularly to such a system principally comprised of members formed from polymeric materials.

BACKGROUND AND OBJECTS OF THE INVENTION

In the construction of small buildings, such as "sheds", the prior art has generally used conventional wood and nail or sheet metal and rivet forms of construction. The cumbersomeness of conventional carpentry procedures and the vulnerability of metal products to rust are examples of deficiencies in the prior art.

This invention provides a "universal" polymeric profile extrusion useful in building construction which reduces assembly effort and allows convenient use of other standard components formed from polymeric materials. The number of different "elements" required in building materials as well as an enhanced ease in assembly is achieved by the invention.

BRIEF DESCRIPTION OF THE DRAWINGS

In the following description of the preferred embodiment.

DESCRIPTION OF THE PREFERRED EMBODIMENT

In its most general description, the invention comprises an overall building construction system including a "universal" structural member used in conjunction with assembly clips which permit the assembly on a modular basis of small scale buildings from light, polymeric panels.

Figure 1:
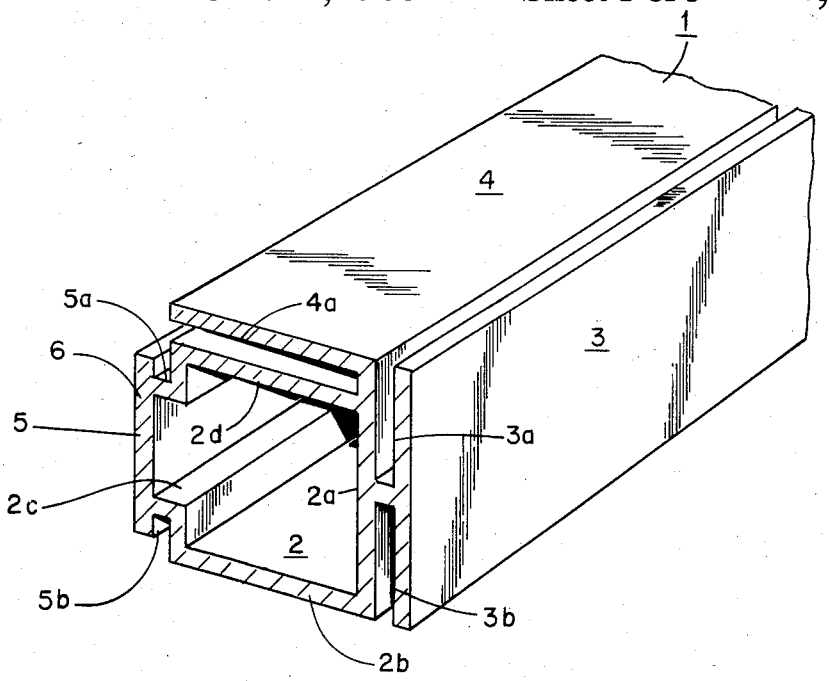
FIG. 1 is a cross-sectional perspective view of the "universal" profile extrusion of the invention.

A section of the universal structural member is shown in FIG. 1 comprising a longitudinally extending extrusion of a single member 1 which in a preferred shape, includes a first rectangular, preferably square form 2, having sides 2*a*, 2*b*, 2*c*, and 2*d* from the center of which on one side 2*a* in FIG. 1 intrinsically extends a "T" 3, which forms two oppositely facing grooves or slots 3*a* and 3*b*. The upper bar of the "T" is preferably co-extensive with the length of the adjacent corresponding side of the rectangular form.

At the side of the square form, perpendicular to the side including the "T", there is included a further intrinsically formed member which forms a single slot having a perpendicular relationship to one of the slots formed by the "T". With reference to FIG. 1, this second slot forming member is shown at 4, co-extending with side 2*d* of the square form and forming a slot 4 a having lateral a perpendicular relationship to slot 3*a*.

On the third side of the rectangular form, there extends a "pi" ("$\pi$") shaped form, shown in FIG. 1 as 5, which in turn forms two further slots 5*a* and 5*b*, as shown having a depth less than the slots formed by the "T" memeber on the opposite rectangular side. The extent of the bar member 6 of element 5 which forms slots 5*a* and 5*b*, with respect to its related side of the rectangular form 2*c* should be less than the length of side 2*c* so that a sufficient clearance, as will be explained below, is permitted for the fastening clips of the invention.

Thus, it can be seen that the universal extrusion of the invention is a rectangular form having two oppositely facing laterally extending slots on the first side thereof and on an adjacent perpendicular second side, having a slot facing perpendicularly away from the opening of the slot on the first side, and on the third side, opposite the first side, has two further oppositely facing longitudinally extending slots formed by a member which does not extend beyond the outer sides of the principal rectangular form. Preferably the structural member is formed from an extrudable durable plastic, polymeric material such as polyvinyl chloride or an equivalent.

Figure 2:
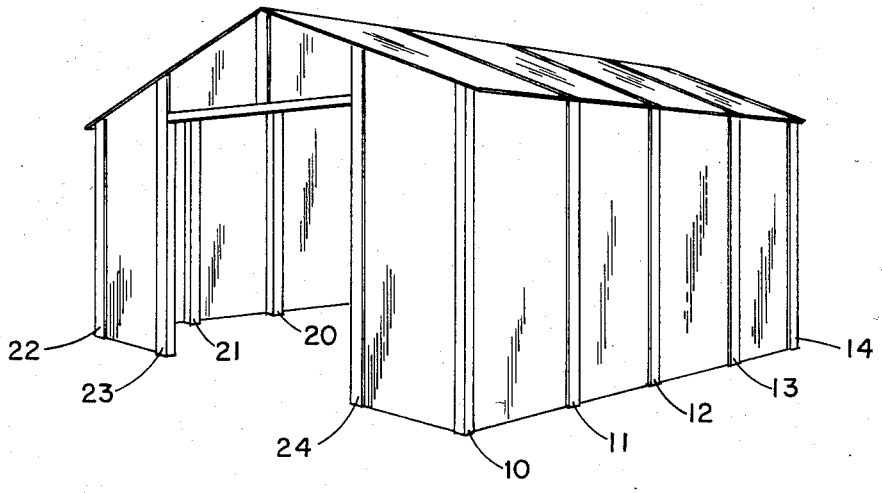
FIG. 2 is an orthographic view of a "shed" assembled with the element of FIG. 1.
Figure 2A:
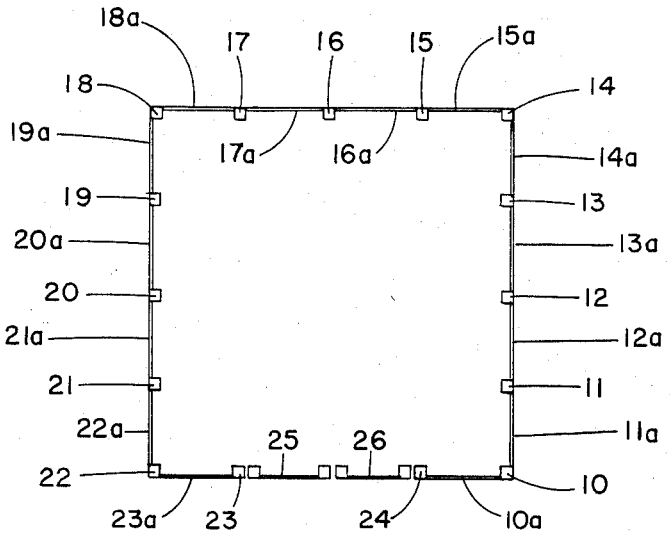
FIG. 2A is a plan view of the shed of FIG. 2 showing locations for placement of the extrusion at the side walls.
Figure 2B:
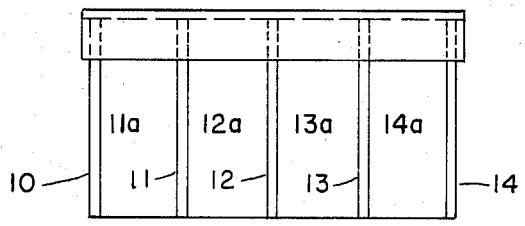
FIG. 2B is a side view of the shed of FIG. 2
Figure 2C:
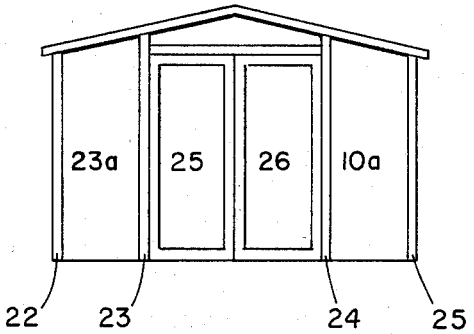
FIG. 2C is a front view.

FIG. 2 is an orthographic view of a small building, such as a garden shed constructed from the universal extrusion of FIG. 1 using "standard" width polymeric panels, such as double wall (corrugated) polyethylene sheet approximately 0.25 inch in thickness. Such sheets are commercially available in standard panels approximately 26.0 inches wide and 60.0 inches long. FIG. 2A is a cross-section plan view showing the location for vertical placement of the universal extrusions of FIG. 1 which form the studding for the building. Such extrusions are placed at predetermined centers appropriate to the width of the panel, with an allowance for the width of the extrusion beginning at a first corner 10, to form a first wall through locations 11, 12 and 13 to second corner 14, to a second wall at locations 15, 16 and 17 to third corner 18, to third wall 19, 20 and 21 to fourth corner 22 to thereby form an encloseable perimeter. The front wall which has a door includes extrusion locations at 23 and 24 which support the separate door panels indicated at 25 or 26. In anchoring such a building to the ground or a foundation, vertical posts having a size approximately that of the interior cross section of the extrusion 2 are driven into the ground, or extended from a given foundation and the extrusion is slid over the post and secured thereto by, for example, a wood screw or other fastener. In this regard, if the center cross-section 2 of the extrusion is a 1.0 inch square, conventional surveyor's stakes are suitable.

The polymeric sheet wall panels employed between adjacent vertical extrusion studs are indicated respectively at 10*a* and through 23*a*.

Figure 3:
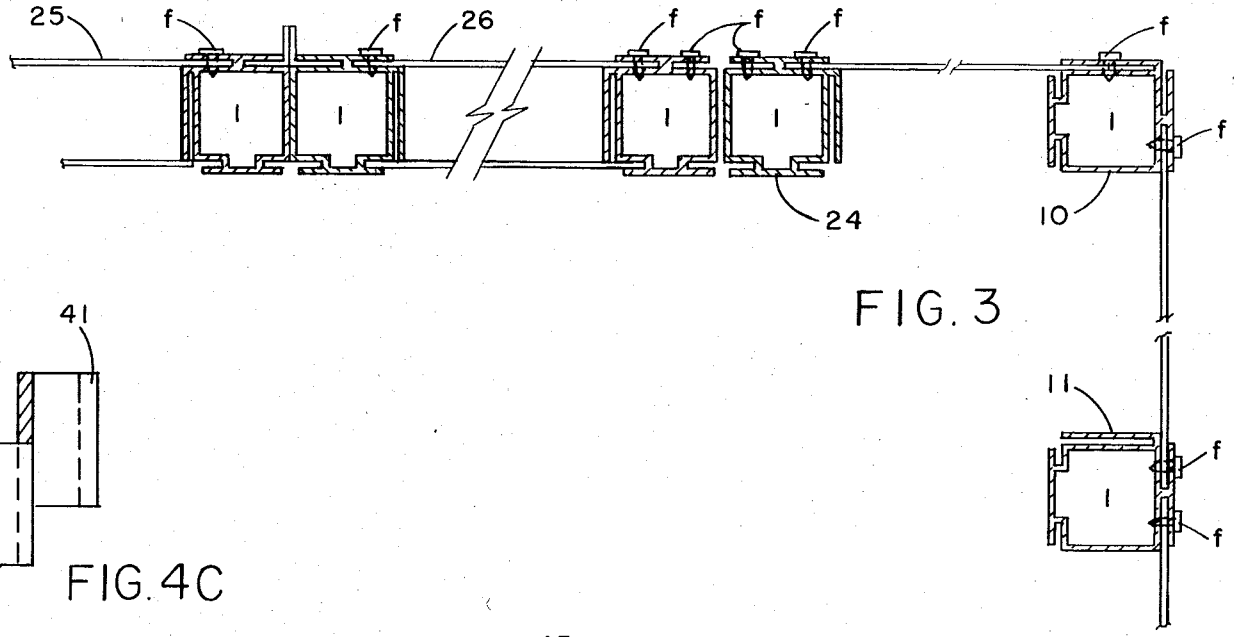
FIG. 3 is an assembly detail view showing use of the profile extrusion of FIG. 1 as a panel edge joint, corner, door jamb, and door cleavage member.

FIG. 3 shows a cross-sectional detail of the assembly of the wall cover and door. Sharp tip polymeric snap rivets or other forms of fasteners which can be pushed through the polyethylene sheet are employed to secure the sheet panels to the extrusions. Such fasteners are designated with a lower case "f" in FIG. 3 and are spaced at periodic vertical intervals along the extrusions which form the wall studs of the system. With regard to the door, a "living hinge" as that term is commonly understood in the plastics fabrication art is used as a hinge between the jamb post and door panel in oppositely facing slots formed by the "T" section of the universal extrusion. An "L" shaped extrusion may be similarly joined to the opposite end of the door panel to provide a lock at the door cleavage, or other means may be used to maintain the door in a closed position. An interior foam panel within the door provides added strength and may be maintained in place by a further outer panel or brace extending within adjacent sides of the slots formed by the "pi" side of the extrusion. Such an alternate form of construction is shown in the dotted lines of FIG. 3 showing a separate interior panel or brace maintained in the "pi" section slot to form an air space or maintain a foam or other insulation therein or otherwise filled with some other material, for example, if a stronger wall is required for security purposes.

Figure 4C:
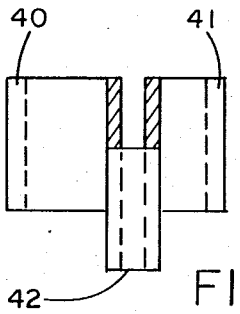
FIGS. 4A, 4B, and 4C are respectively cross-section, plan, and side elevation views of a fastening clip used in conjunction with the invention.
Figure 4B:
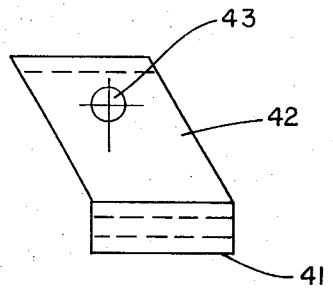
Figure 4A:
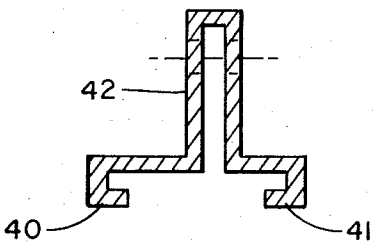

FIGS. 4*a*, 4*b* and 4*c* show the fastening clip specially adapted for use with the universal extrusion of the invention. The clip is essentially adapted to provide inward facing legs which are insertable within the slots formed by the "pi" side of the extrusion and include an offset perpendicularly extending segment so that when two clips are oppositely oriented with respect to the extrusion longitudinal axis, the center of the rectangular section of the extrusion is aligned with one side of the offset clip extension. In FIGS. 4A, 4B, and 4C, the inward facing legs of the clip are shown as 40 and 41, the extending segment which perpendicularly extends therefrom is shown as 42 and a hole through the segment is indicated at 43. Such clips can be stamped out of steel or aluminum or injection molded or extruded and cut from a suitable material.

Figure 5:
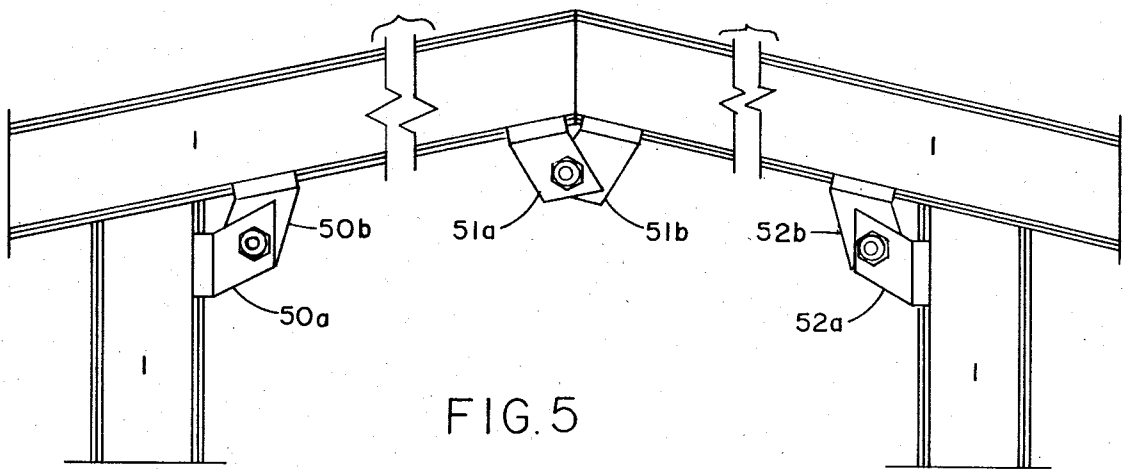
FIG. 5 is a detail view of the truss framing system using the profile extrusion and fastening clips of the invention.
Figure 5A:
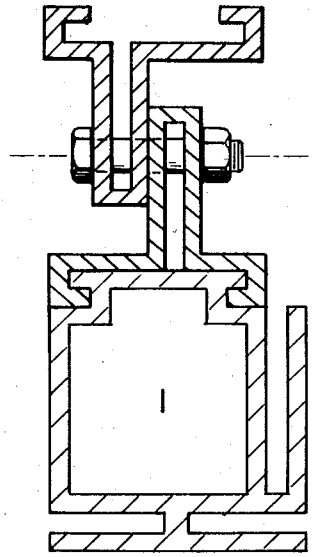
FIG. 5A is a further detail view showing the assembly relationship of the extrusion and clip and FIG. 5B is a perspective view showing the connection point between two clips.
Figure 5B:
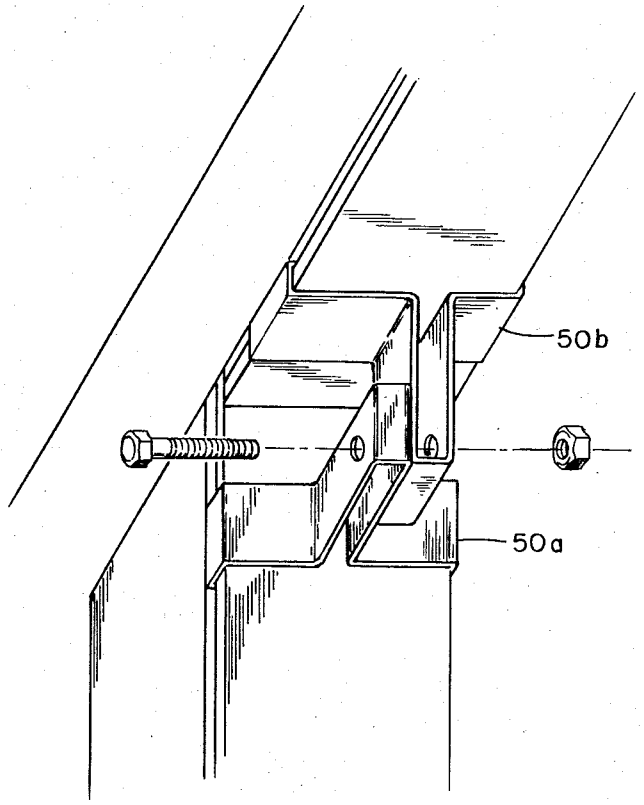
Figure 5C:
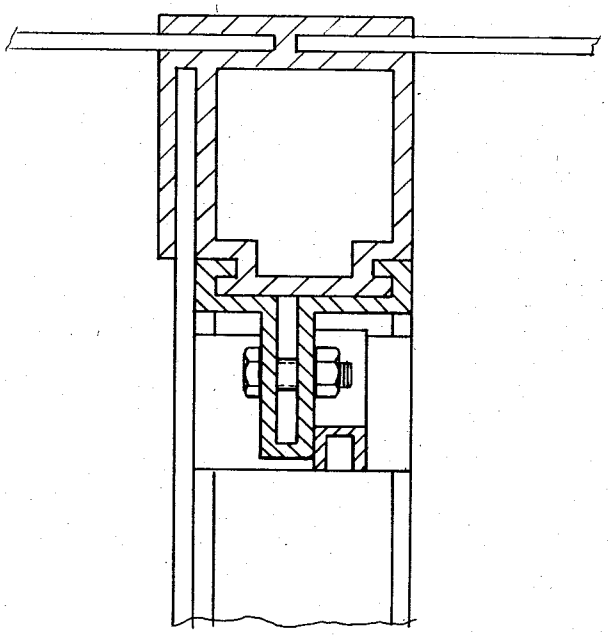

FIG. 5 is a detail view of a truss forming system using the clips and extrusions of the invention showing clip pairs 50*a* and 50*b*, 51*a* and 51*b* and 52*a* and 52*b* joining the wall and gable roof at the respective side walls and roof peak maintained by nut and bolt or other fasteners 50*c*, 51*c* and 52*c*. As is apparent the clip joins adjacent beams and is adjustable to many different angles. The clips may also be used to support shelving and to attach other elements to the extrusions. In FIG. 5A, the relationship of the clips 55*a* and 55*b*, bolt or fasteners 55*c* and extrusion 55*d* is shown. In FIG. 5B, a further detail of the clip and beam assembly at a wall/roof intersection is depicted.

From the foregoing description, it can be seen that the universal structural extrusion of the invention used in conjunction with standard panels and the specially adapted clips may be adapted to many building applications and can be used to provide a building system formed entirely of polymeric components. Transparent or translucent panels may be used to form a greenhouse, a section of clear plastic such as acrylic may form a window and the size of structures and/or rooms therein is limited only by the number and size of the polymeric panels used.

What is claimed is:

1. A universal structural profile extrusion including a longitudinally extending structural form having a rectangular cross section defined by four wall segments in which:

from a first wall segment there extends an intrinsic "T" shaped member to form separate, oppositely facing first and second channels between the first wall segment and the "T", each of said channels adapted to receive the side section of a panel of predetermined thickness;

from a second wall segment, adjacent and perpendicular to the first wall segment, there extends a channel forming leg parallel to the second wall segment, having a foot intrinsically connected to the corner of the first and second wall segments of the rectangular form, whereby a third channel is formed which is perpendicular to and facing away from the adjacent channel formed by one side of the "T" on the first wall segment, said third channel adapted to receive the side section of a panel of predetermined thickness;

from a third wall segment opposite the first wall segment, there extends an intrinsic "pi" shaped section, in which the section corresponding to the cross bar of the "pi" does not extend beyond the second wall segment and the opposite fourth wall segment of the rectangular form, and forms two oppositely facing channel slots having opposite internal sides of a determined spacing.

2. An assembly of the profile extrusion of claim 1 and a panel inserted into one of the first, second and third channels of the extrusion.

3. An assembly of two separate lengths of the extrusion of claim 1 in which the lengths of extrusion are fastened to each other by two clips, each clip including a means for fastening one clip to another and further having oppositely facing inwardly extending leg segments inserted within the slot channels formed by the "pi" section extending from the third wall segment of the respective extrusions;

Each clip further having a middle section perpendicularly coextending with respect to the third wall segment of the extrusion, said perpendicularly extending section being offset with respect to the middle thereof, and attached in opposite orientations with respect to each other on the respective extrusion, such that when the two clips are fastened to each other, the respective centers of each extrusion are aligned with the other.

* * * * *